US011383882B2

(12) United States Patent
Dimer

(10) Patent No.: US 11,383,882 B2
(45) Date of Patent: Jul. 12, 2022

(54) TRANSPORT AND STORAGE CONTAINER

(71) Applicant: montara Verpacken mit System GmbH, Großschirma (DE)

(72) Inventor: Christoph Dimer, Teltow (DE)

(73) Assignee: montara Verpacken mit System GmbH, Großschirma (DE)

( * ) Notice: Subject to any disclaimer, the term of this patent is extended or adjusted under 35 U.S.C. 154(b) by 0 days.

(21) Appl. No.: 17/288,940

(22) PCT Filed: Jun. 17, 2020

(86) PCT No.: PCT/DE2020/100509
§ 371 (c)(1),
(2) Date: Apr. 27, 2021

(87) PCT Pub. No.: WO2021/047710
PCT Pub. Date: Mar. 18, 2021

(65) Prior Publication Data

US 2021/0380312 A1 Dec. 9, 2021

(30) Foreign Application Priority Data

Sep. 13, 2019 (DE) ..... 10 2019 124 657.1

(51) Int. Cl.
*B65D 21/02* (2006.01)
*B65D 25/04* (2006.01)
*B65D 25/08* (2006.01)

(52) U.S. Cl.
CPC ..... *B65D 21/0224* (2013.01); *B65D 21/0213* (2013.01); *B65D 21/0215* (2013.01); *B65D 25/04* (2013.01); *B65D 25/08* (2013.01)

(58) Field of Classification Search
CPC ..... B65D 21/0224; B65D 25/04; B65D 21/0213; B65D 21/0215; B65D 5/0055
USPC ..... 206/503
See application file for complete search history.

(56) References Cited

U.S. PATENT DOCUMENTS

| | | | |
|---|---|---|---|
| 5,295,632 | A | 3/1994 | Zink et al. |
| 2007/0221719 | A1 | 9/2007 | Vroon et al. |
| 2012/0061277 | A1 | 3/2012 | Lohse |
| 2017/0073106 | A1 | 3/2017 | Dimer |

FOREIGN PATENT DOCUMENTS

| | | | |
|---|---|---|---|
| DE | 9311040 | U1 | 10/1993 |
| DE | 9408451 | U1 | 9/1994 |
| DE | 20211459 | U1 | 10/2002 |

(Continued)

*Primary Examiner* — Andrew D Perreault
(74) *Attorney, Agent, or Firm* — Smartpat PLC

(57) ABSTRACT

A stackable transport and storage container includes a bottom, two side walls, two end-face walls, and inner partitions and/or a container cover. The inner partitions and/or a container cover can be detachably fastened to the container without the aid of tools and additional fastening elements. In the storage and transport container, the side walls and the end-face walls comprise folded-over edges, above which stacking profiles which are open at the bottom can be placed. The connecting piece of the stacking profile, which piece forms the stacking support, has profiling in the form of a keder holder into which a pull-in keder, having a keder core and a keder flap, can be inserted. Partitions for receiving transport and storage parts and/or the protective cover are fastened to at least one keder flap.

5 Claims, 7 Drawing Sheets

(56) References Cited

FOREIGN PATENT DOCUMENTS

| | | | |
|---|---|---|---|
| DE | 20114888 | U1 | 12/2002 |
| DE | 20217922 | U1 | 2/2003 |
| DE | 102010037517 | | 12/2011 |
| DE | 102011055676 | A1 | 5/2013 |
| DE | 102013002736 | A1 | 8/2014 |
| DE | 202015100895 | U1 | 3/2015 |
| DE | 102015115592 | A1 | 3/2017 |
| DE | 102018001937 | A1 | 9/2019 |
| EP | 0674595 | A1 | 10/1995 |
| EP | 1505001 | A1 | 2/2005 |
| FR | 3074483 | A1 | 6/2019 |
| WO | 9414662 | A1 | 7/1994 |
| WO | 2007112376 | A3 | 9/2008 |

TRANSPORT AND STORAGE CONTAINER

CROSS-REFERENCE TO RELATED APPLICATION

This application is a national phase entry of international application PCT/DE2020/100509, filed 2020Jun. 17, and claims the benefit of German Patent Application No. 10 2019 124 657.1, filed 2019 Sep. 13.

TECHNICAL FIELD

The invention relates to a stackable transport and storage container which comprises at least a base, two side walls and two end walls and also inner dividers and/or a container covering.

BACKGROUND

Transport and storage containers are used, in particular, wherever tools or components are to be transported, or stored on an interim basis, within the context of a production process. They usually consist of metal sheets or plastic panels, which are adhesively bonded, welded or connected to one another in a form-fitting manner In addition to having a sufficient load-bearing capacity and service life, it is also important here for the containers, as far as possible, to have no protrusions or offset portions, which constrict, or otherwise obstruct, the interior space.

Containers made of metal, although relatively stable, are often very heavy, susceptible to corrosion and noisy to use. Containers made of plastics have the advantage of having a relatively low weight. On the other hand, they often have only a low level of stability, which is compensated for again by additionally reinforcements.

Different designs of injection-molded containers and also containers produced from hollow-chamber PP material are known for comparable applications. The injection-molded containers are containers which are produced in complex molds. The high tool costs mean that these can be effectively produced only in large numbers.

Comparable hollow-chamber PP containers are distinguished either in that they are joined together from a large number of individual parts, which entail a large number of individual operating steps, or by straightforward folding and bending constructions, which are held in shape by means of an all-round stacking profile. Use is made here of folding by thermal means, ultrasonic welding, adhesive bonding and other joining and processing techniques. The containers are distinguished, in principle, in that low tool costs mean that it is also possible to produce relatively small numbers with a wide variety of different dimensions.

EP 1 505 001 A1 describes a stackable load carrier made of thermoplastic material for storing and, in disposable or reusable form, for transporting small items of all kinds. The load carrier is always produced from thermoplastic material. It has a base and usually four side walls, which are produced from a planar starting pane. This starting panel is preferably a hollow-camber panel.

Linear notching is introduced between the base and the side walls, and the side walls can be swung about said notching to form a box-like main body. The abutting vertical edges of the side walls are welded. The upper edges of the side walls are adjoined by a rolled periphery, which has been swung through 180° about linear notching in the starting panel onto the respective side walls. A stacking profile is clipped in a form-fitting manner over the rolled periphery such that a protrusion, which is formed on the stacking profile, fixes the stacking profile on the roller periphery.

EP 0 674 595 B1 describes a stackable transport container having a self-locking upper periphery. The container comprises a foldable, uniform-thickness container blank having a base, two upright end walls, two upright side walls and four end flaps. The side walls and the end walls have downwardly folded tabs, over which is fitted an upper periphery, which latches in automatically on the tabs.

Horizontal forces are absorbed by the all-round, single-part upper periphery and by the additional corner reinforcements or insertable corner profiles. It is therefore necessary for separate peripheries to be provided for each size of container. The large number of additional corner parts renders the production and assembly outlay very high.

Folded containers with a stacking periphery running all the way round the top are also described, for example, in DE 10 2015 115 592 B4 and DE 10 2010 037 517 B3.

Fixtures inside transport and storage containers can be fastened on the inner sides of the containers using additional fastening devices, for example hook-and-loop strips or rails.

DE 10 2011 055 676 A1 describes a multiply reusable transport pallet for transporting items. Item holders, which can be inserted into the pallet are fastened by guiderails with item strips, which can be accommodated therein.

A keder is the peripheral reinforcement of a textile or of a sheet material. The keder has a round cross section and, for fastening purposes, a wide, flat keder flap. The latter provides the connection between the textile/sheet material and keder. The keder flap is often a sheath, in which the keder bead is incorporated. The keder flap and the sheet materials or textiles which are to be fastened are usually welded or sewn to one another.

A keder rail is the part of tension mechanisms into which the keder is introduced. The rail is a cross-sectionally round guide groove, in which the keder is introduced, and can be displaced, longitudinally in a friction-free manner. The keder and keder rail thus make it possible for a tarpaulin or the like to be tensioned over its surface area in the direction transverse to the edge line.

A keder rail is often used in outdoor advertising, tent construction or for large (movie)screens.

The operation of mounting the keder rail is very easy because, depending on the application area, it can be adhesively bonded or screw-connected. In an application area where high tensile forces are to be expected (caused by wind, etc.), screw-connection is imperative. For safety reasons, we recommend that the rail should always be screw-connected. The holes here can be easily self-tapped.

DE 20 211 459 U1 discloses a compartment insert comprising flexible compartment dividers for installing in a container. The compartment insert comprises a supporting structure, which can be inserted into the container, and flexible compartment dividers, which are connected to the supporting structure. The flexible compartment dividers can be connected to the supporting structure in a force-fitting and form-fitting manner by means of an insertion system. The supporting structure comprises two spaced-apart transverse and longitudinal struts, which have tabs which are inserted into slots in the transverse struts. The flexible compartment dividers are arranged between the transverse and longitudinal struts. In a particular embodiment, the compartment dividers are reinforced along the upper edges by a keder profile.

DE 9 408 451 U1 concerns an air bag for lining a stiff-walled transport container. At least one additional retaining element is formed along the upper periphery of the air bag, and said retaining element can be connected in a removable manner to the edge or inner surface of a side wall of the transport container.

DE 93 11 040 U1 discloses a keder profile which is firmly screwed to the inner surface of the side wall of a transport container and in which it is possible to fit an air bag with a rubber cord formed along its upper periphery.

The aforementioned fastening options require connecting structures in the form of additional fixtures, which increase the manufacturing outlay. Moreover, these fixtures usually additionally constrict the inside cross section of the containers.

SUMMARY

It is the object of the invention to propose a transport and storage container in the case of which inner dividers and/or a container covering can be fastened in a releasable manner on the container without the aid of tools and additional fastening elements. The intention here is for as few protrusions and offset portions as possible to delimit, or constrict, the interior space of the containers. Production and assembly should be possible with little outlay.

The object is achieved according to the invention by the features as claimed.

The transport and storage container comprises at least a base, two side walls and two end walls and also inner dividers and/or a container covering. The side walls and the end walls have rolled peripheries, which can be swung about a folding line in each case onto the associated side wall and end wall. Stacking profiles which are open in the downward direction can be fitted on over the rolled peripheries of the side walls and of the end walls. Said stacking profiles have an inner leg, an outer leg and also a hook periphery, which is formed on the outer leg or inner leg. In the fitted-on state, said hook periphery can be latched over the end of the swung-over rolled periphery of the side walls and of the end walls.

The connecting cross piece between the outer leg and inner leg forms a stacking support. The stacking profiles have an upper stacking periphery, which is formed on the outer leg.

The connecting crosspiece between the outer leg and inner leg of each of the stacking profiles, said connecting crosspiece forming the stacking support, has a profiling, which is designed in the form of a keder holder. A keder having a keder bead and a keder flap can be pushed into said keder holder. The protective covering and/or the dividers for accommodating transportation and storage items are fastened on at least on keder flap.

In a preferred embodiment, the stacking profile is a plastic injection molding. Depending on the size of the transport and storage containers, the stacking profile can be cost-effectively produced in large numbers and cut to size.

A preferred embodiment is one in which the all-round stacking profile comprises a continuous, multi-part profile. The individual, all-round parts of the stacking profile can be swung outward, about a folding line, at the corners of the transport and storage container to such an extent that a keder can be pushed into the keder holder. In the region of the corners here, the stacking profile has V shaped cutouts, which allow the individual stacking-profile parts to be swung inward through approximately 90°, in which case they come into contact flush against the adjacent part of the corresponding stacking profile.

If the stacking profile is of 5 part design, it is possible, in the fitted-on state, for the first part of the stacking profile to be connected to the fifth part in abutment therewith, for example by welding or by adhesive bonding.

The base, the side walls, the end walls and the swing-over rolled periphery preferably comprise plastic structured-core panels. Structured-core panels comprise two spaced-apart cover panels with connecting crosspieces, designed in the form of protuberances, located therebetween. When use is made of structured-core panels, the folding lines are provided on the wall side located within the container, and a predetermined line of inflection is produced as a result. On the outside, the container is in a state in which it has been merely bent over along the folding lines, and therefore closed. This results in a closed container with no sharp edges.

In the case of structured-core panels, the scored line is formed along the rolled peripheries by the inner panel wall being cut open, in which case the flaps can easily be bent around the side periphery.

In order to make savings on the amount of materials used and to reduce weight, the connecting crosspiece, which connects the outer leg and inner leg of the stacking profiles, can have a cavity.

The transport and storage container preferably comprises a single-piece and foldable container blank. The container blank has a base, two side walls, which can be swung about a folding line, and two end walls, which can be swung about a folding line. The folding lines are grooved, stamped, rolled or scored. Use is preferably made of a plotter, which generates the contours of the container blank as a whole.

When the contours of the container blank are being produced, rolled peripheries are provided in each case along the upper periphery of the side and end walls, which can be swung upward, it preferably being possible for said rolled peripheries to be swung inward in each case about a scored line or onto the associated side wall and end wall. The rolled peripheries can be swung both outward and inward.

The stacking profile, which is open in the downward direction, is fitted on around the upper rolled periphery, which has double wall thickness as a result of being swung over. The stacking profile is of U shaped design. It has two legs—an inner leg and an outer leg—wherein a hook periphery is formed on the inside of the inner leg. The hook periphery is provided at such a height that it extends beneath the lower part of the rolled periphery and hooks in there. The hook periphery can be designed to be inclined upward through an angle <90°. The stacking profile thus snaps in automatically over the periphery of the upright side and end walls and is securely arrested.

In the case of a rolled periphery which is swung outward, the stacking profile is adapted such that the hook periphery on the outer leg hooks in beneath the rolled periphery.

In order for a plurality of containers to be stacked to good effect, the stacking profiles have identically shaped stacking peripheries formed all the way round.

Depending on the loading capability desired, it is also possible for a transport and storage container to consist entirely, or at least partially, of corrugated board or aluminum-honeycomb material.

The transport and storage containers, while being of low weight, have a high level of stability and load-bearing capacity. Inner dividers and/or a container covering can be fastened in a releasable manner in the container without the aid of tools and additional fastening elements. Even if the sides are subjected to pronounced impact, for example by a further box being pushed on abruptly, the connections cannot come loose. The surface area of the container blank is utilized to very good effect. The stacking profiles are produced with real savings being made on the amount of material used. The profiles and injection-molded corners used can be standardized and cost-effectively produced beforehand, and stored, in large numbers.

The invention will be explained in more detail hereinbelow with reference to an exemplary embodiment.

BRIEF DESCRIPTION OF THE DRAWINGS

FIG. 3 shows the stacking profile fitted on with a keder pushed in.

DETAILED DESCRIPTION

The exemplary embodiment described is a preferred variant of a container for transporting and storing small items relating to automobile production. The finished transport and storage container should have dimensions of 800×600×250 (L×W×H in mm).

Figure 1:
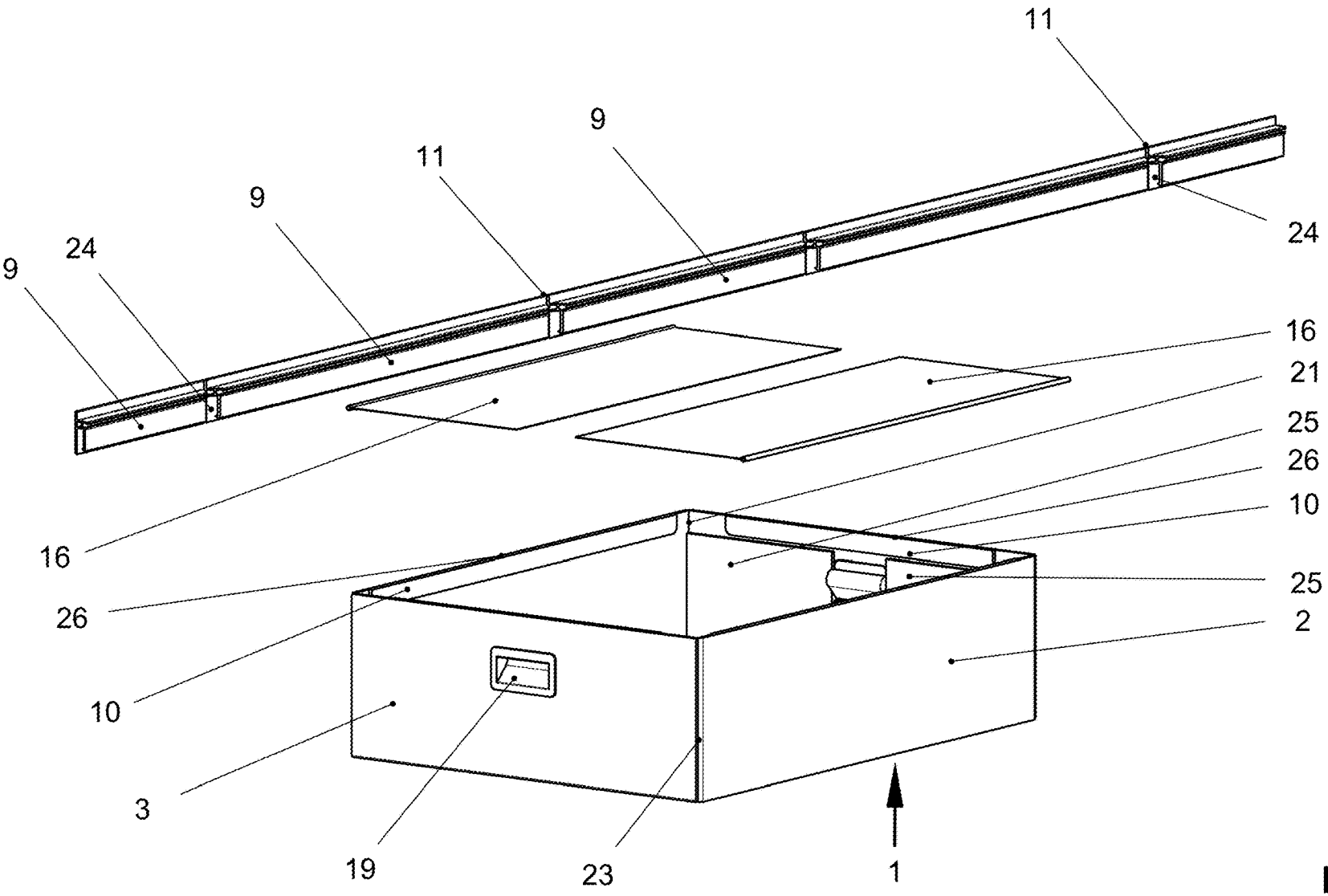
FIG. 1 shows a partially exploded view of a container having stacking profiles and a keder-type covering.

FIG. 1 shows a partially exploded view of a transport and storage container having stacking profiles 9, which can be fitted on, and a protective covering 16, which can be fastened on the stacking profiles 9 for the purpose of protecting items which are to be transported.

The transport and storage containers are produced from a foldable container blank. The latter comprises a single-piece plastic structured-core panel with a thickness of 5 mm. A plotter is used to generate a contour, and this results in a base 1, two side walls 2, which can be swung about a folding line 21, and two end walls 3, which can be swung about a folding line 21. In each case two corner flaps 25, which can be swung inward about a folding line 21, are formed on the two side walls 2.

The corner flaps 25 are long enough for them, in the folded state, to cover over the width of the end wall 3 and to butt against one another in the center of the end walls 3. The corner flaps 25 contain handle cutouts for the handles 19, which can be inserted at a later stage. Handle cutouts are also made in each of the two end walls 3. The insertion of the handles causes the corner flaps 25 to be retained on the end walls 3, and there is therefore no need for any additional arresting means.

Rolled peripheries 10 are formed along the upper periphery of the side walls 2 and end walls 3, which can be swung upward, it being possible for said rolled peripheries to be swung inward in each case through 180° about a scored line 26 onto the associated side wall 2 and end wall 3. The scored line 26 here is formed such that the outer cover panel of the structured-core panel is cut all the way through and the swing-over action takes place about the second wall, which subsequently forms the inner wall. There is no need for the rolled peripheries 10 to extend over the entire width of the side and end walls.

Stacking profiles 9, which are open in the downward direction, can be fitted on over the rolled peripheries 10 of the side walls 2 and of the end walls 3.

Figure 2:
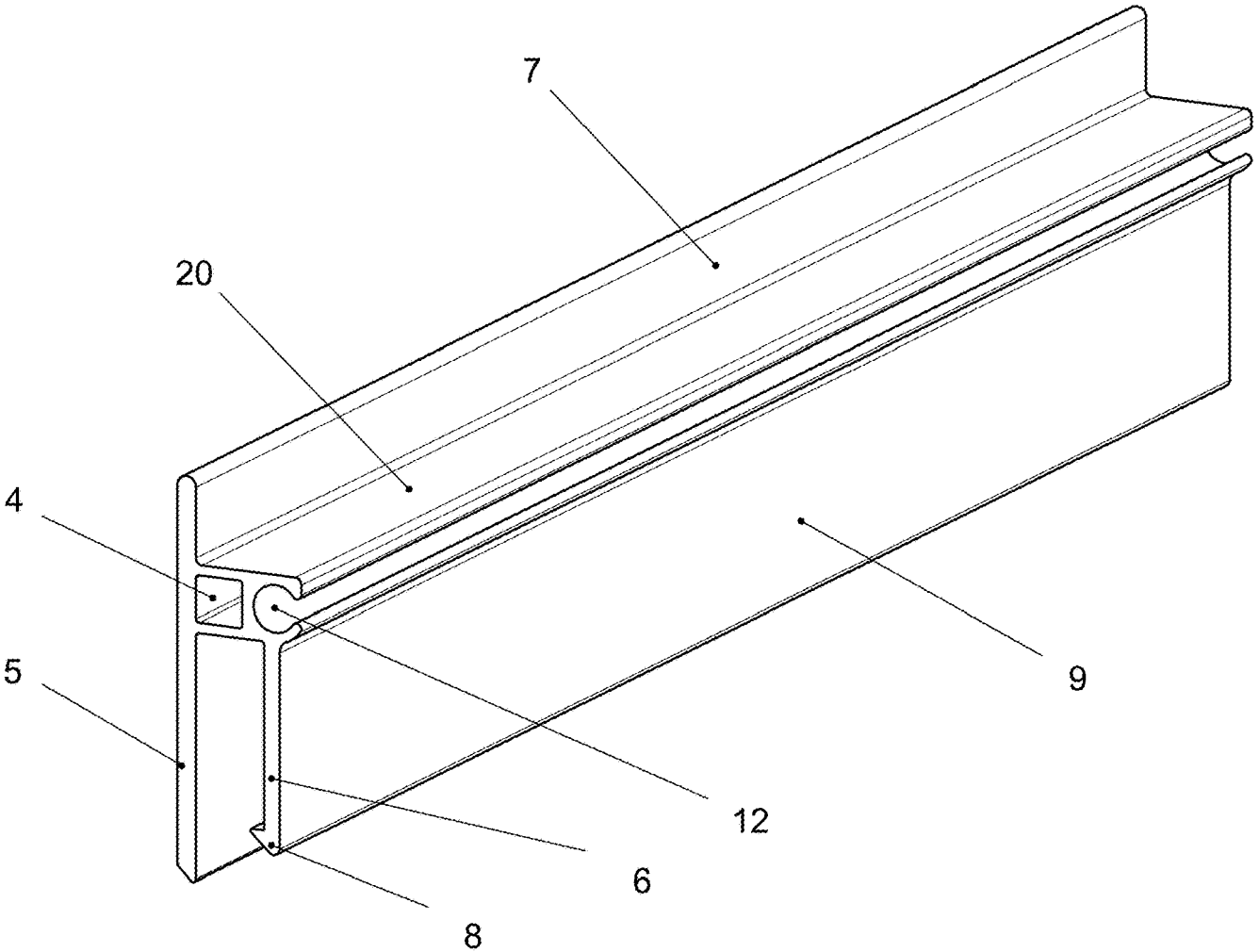
FIG. 2 shows a stacking profile.

FIG. 2 shows an individual stacking profile 9 on its own. It is formed by an inner leg 6, an outer leg 5 and also a hook periphery 8, which is formed on the outer leg 5 or inner leg 6 and, in the fitted-on state, can be latched over the end of the swung-over rolled periphery 10 of the side walls 2 and of the end walls 3. The connecting crosspiece between the outer leg 5 and inner leg 6 forms a stacking support 20 for further, stackable storage and transport containers.

The connection crosspiece 22 of the stacking profiles 9, said connecting crosspiece forming the stacking support 20, has an inner profiling which is designed in the form of a keder holder 12. The keder holder 12 is located as closely as possible beneath the stacking support 20, so that optimum use is made of the interior space of the container. At the same time, the keder holder 12 results in an increase in the supporting surface area for the next load carrier.

Figure 3:
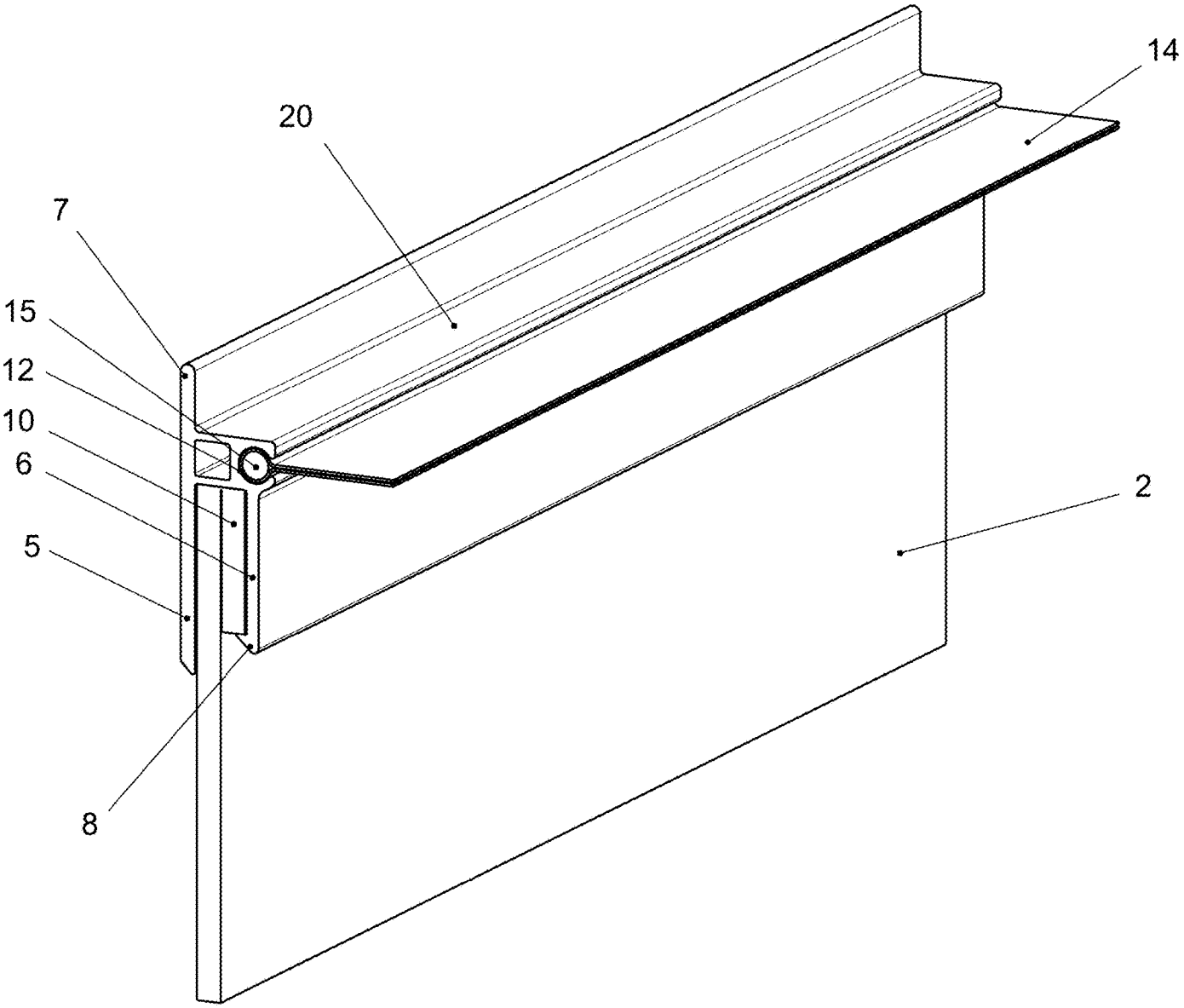
Figure 4:
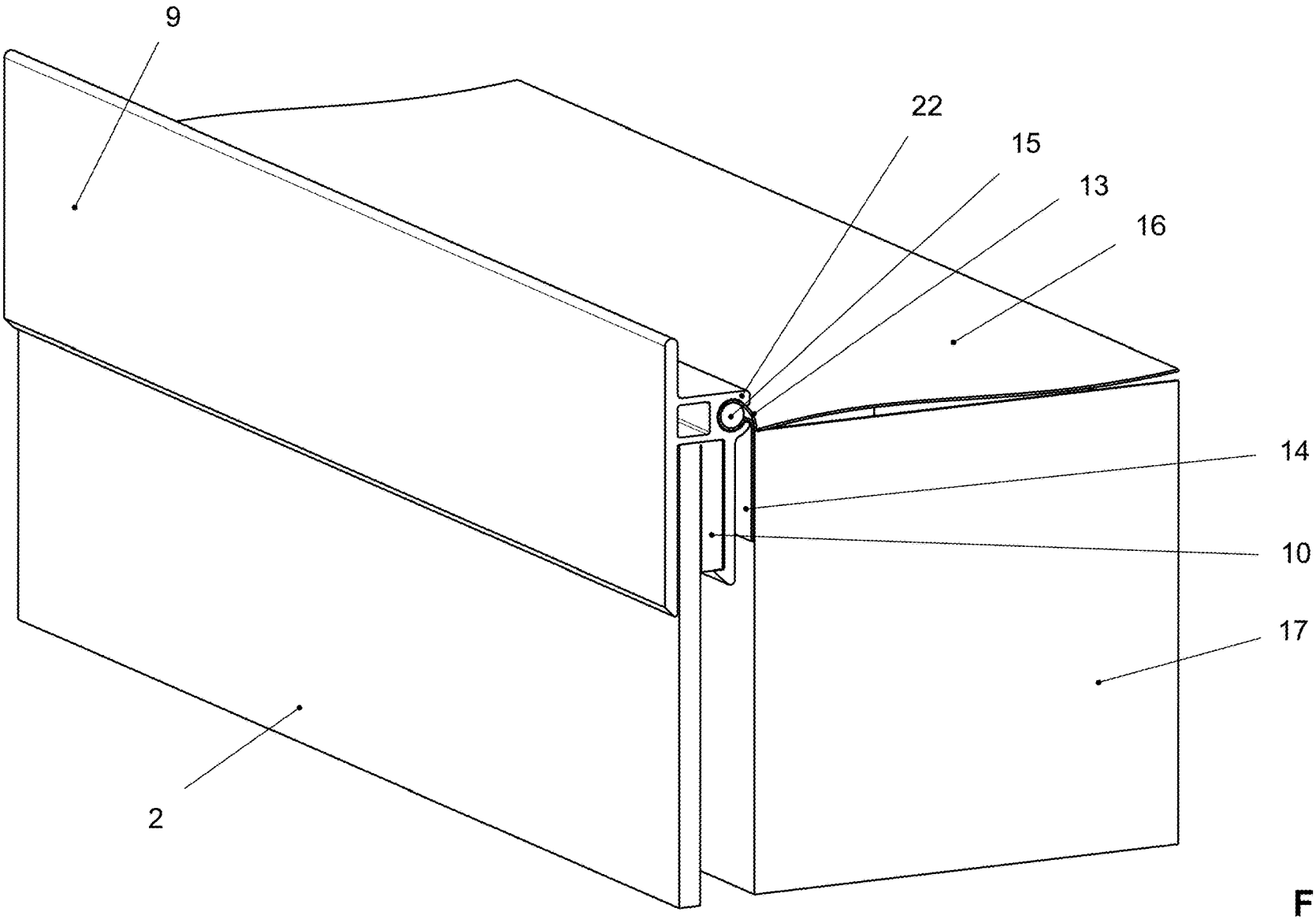
FIG. 4 shows dividers, with a protective covering, fastened on the keder.

A keder 13, which is formed from a keder bead 15 and a keder flap 14, can be pushed into the keder holder 11 according to FIG. 3. The keder bead is a round plastic profile. A protective covering 16 and dividers 17, for accommodating transportation and storage items, are fastened according to FIG. 4 on the keder flap 14, which can be a textile or sheet material. The protective covering serves to protect the items against being soiled during transportation. The dust-protection textiles or dust-protection sheet materials can rest on the dividers 17. Two protective coverings 16 made of textiles or sheet materials can rest opposite one another, and/or in an overlapping state, on the dividers 17.

The rectangular cavity 4 is necessary predominantly for reasons relating to technology and cost saving.

Figure 5:
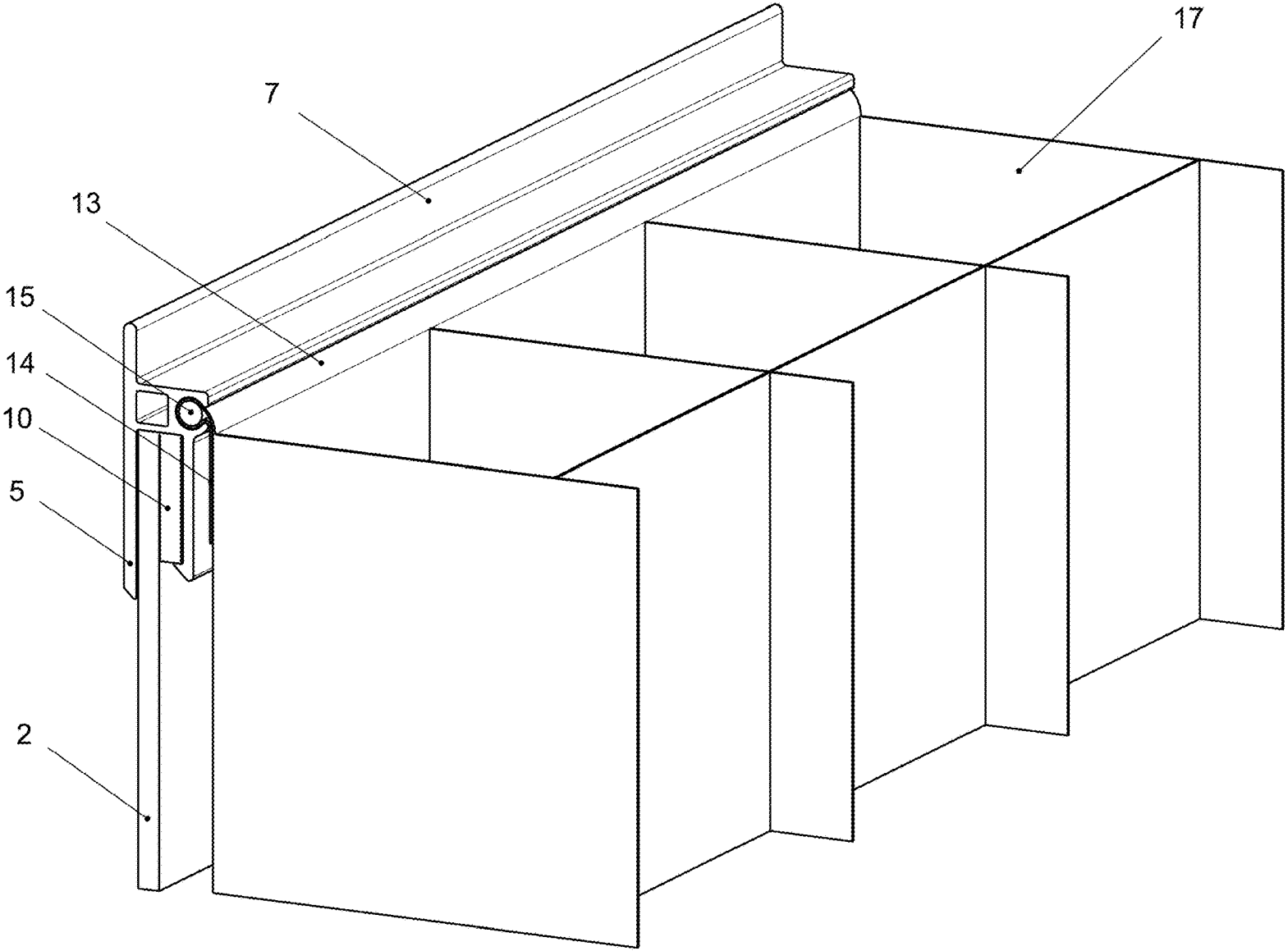
FIG. 5 shows dividers fastened on the stacking profile by means of a keder.

FIG. 5 shows part of a transport and storage container with integrable dividers made of preferably relatively stiff textiles, for example nonwoven fabric made of polyethylene, nylon and more, which are sewn directly to the keder flap 14. In the case of sheet materials, said connection is preferably an adhesive-bonding connection. Sheet materials are likewise sewn or welded. The keder can be a part which is bought in, having a keder bead 15 and short keder flap 14. However, it is also possible for the dividers 17 to be attained with the keder 13 and protective covering 16 already sewn on.

The stacking profile 9 is a plastic injection molding and is of U shaped design. The hook periphery 8 is designed such that it can be inclined upward through an angle of approximately 80°. The inner leg 6 is in a state in which it is bent slightly inward. This permits a slight spreading action when the stacking profile 9 is placed in position. A level of stressing which ensures that the hook periphery 8 is fitted securely is also produced when the stacking profile 9 has been placed in position. The stacking profile 9 thus snaps in automatically over the periphery of the upright side walls 2 and/or end walls 3. The width of the rolled peripheries 10 corresponds to the inner extent of the stacking profiles 9 from their upper stop surface to their hook periphery 8.

In order for a plurality of containers to be stacked to good effect, the stacking profile 9 has a stacking periphery 7 at the top. The stacking periphery 7 terminates flush on the outer side and, on the inner side, is wide enough to allow the next transporting and storage container to be placed in position in a form-fitting manner.

The corners of the transport and storage container here are welded to one another.

In a preferred embodiment, the all-round stacking profile 9 comprises a continuously manufactured plastic profile of which the individual parts can be swung outward about a folding line 11 at the corners 23 of the transport and storage container. This allows the keder 13 to be pushed into the keder holder 12 on the two mutually opposite side walls 2. On account of the V shaped cutouts 24, which are illustrated in FIG. 6, the stacking-profile parts are then bent inward through 90° onto the adjacent stacking-profile part.

Figure 6:
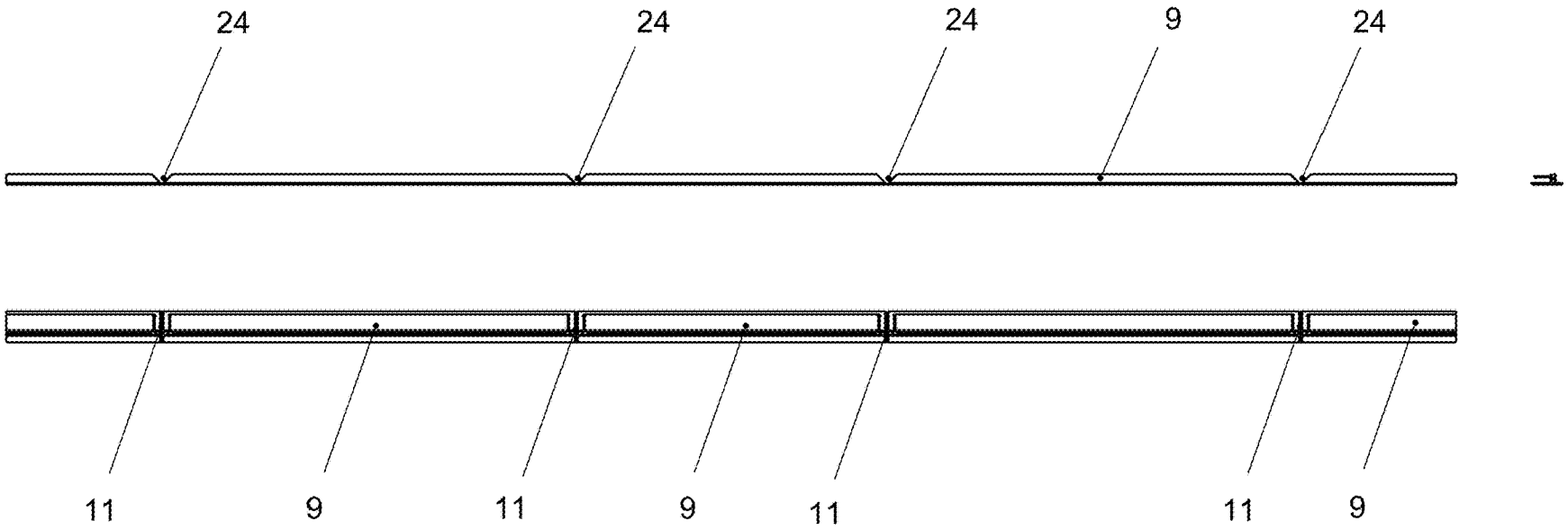
FIG. 6 shows views of an all-round stacking profile.

In FIG. 6, the stacking profile 9 is of 5 part design. In the fitted-on state, the first part of the stacking profile 9 is connected to the fifth part in abutment therewith, for example by butt welding.

Figure 7:
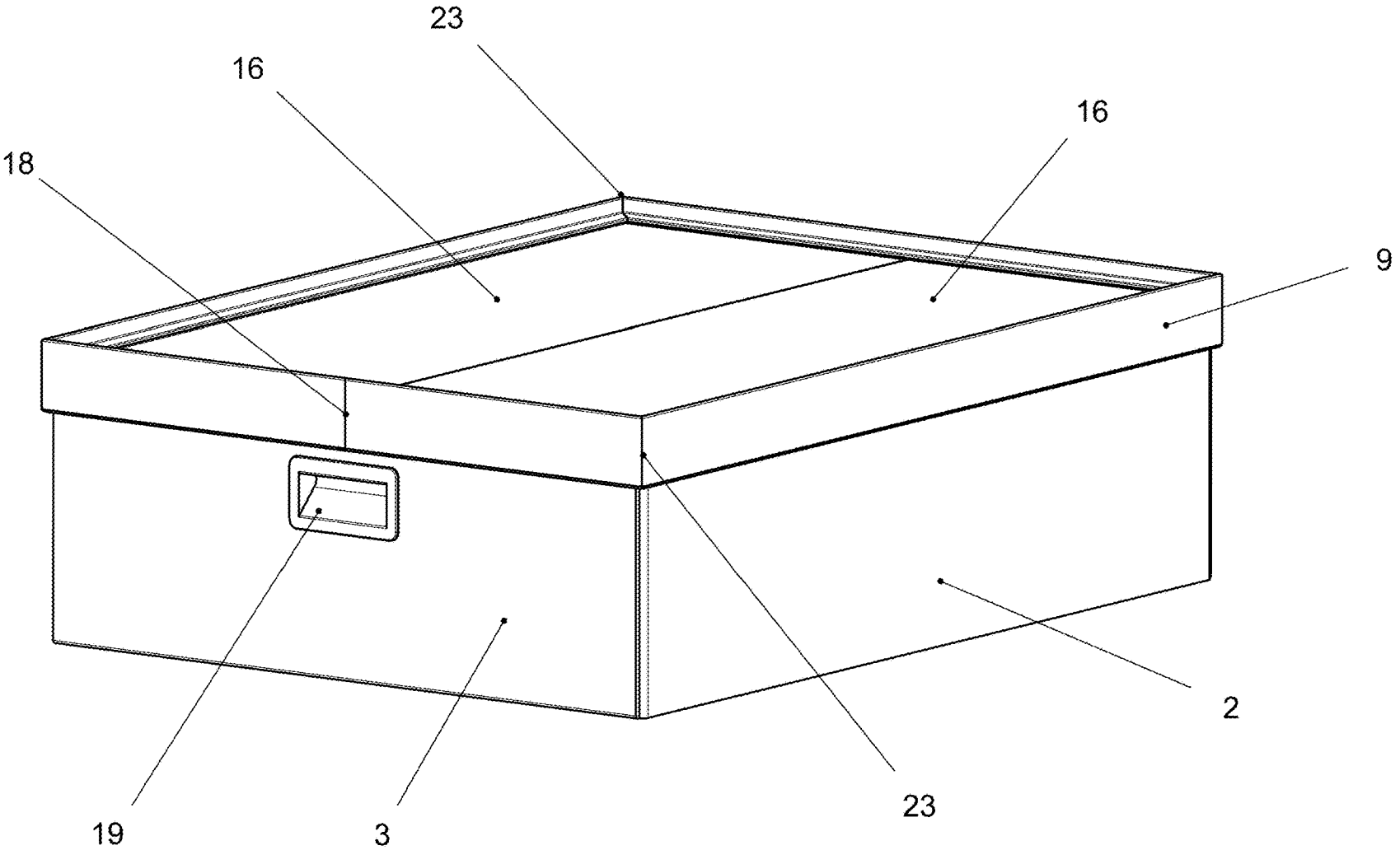
FIG. 7 shows the transport and storage container assembled.

FIG. 7 shows a completely assembled transport and storage container. The small number of components give the transport and storage container a low weight, but it also has a high level of stability. It has few protrusions and offset portions. The container blank can be fully plotted or punched out. This allows strict adherence to dimensional accuracy of the result of contour accuracy, and this means that low manufacturing tolerances are made possible.

The keder rail has not simply been placed in position on a profile which is present; rather, it is integrated in the stacking profile 9 so that, in turn, optimum use is made of the interior space of the transport and storage container.

The small number of parts means that the transport and storage container can be produced straightforwardly and cost-effectively, in particular also because there is no need to acquire any high-outlay systems to provide miter cuts or any welding technology for corners. Additional material for fastening peripheries is not required.

The process times required for box manufacturing are considerably reduced. Poor welding of the critical corners is avoided. Moreover, the profile rods can be used to considerably better effect since a continuous piece has to be manufactured in each case. The straightforward, more lightweight and cost-effective parts mean that this type of container can be assembled, using extremely simple assembly means, pretty much at the site of the customer. A central production facility can supply the end users with the punched-out container blanks, and all that is required is for the end users themselves to insert the keder and fit the stacking profiles 9.

LIST OF REFERENCE SIGNS

1 Base
2 Side wall
3 End wall
4 Cavity
5 Outer leg
6 Inner leg
7 Stacking periphery
8 Hook periphery
9 Stacking profile
10 Rolled periphery
11 Folding line
12 Keder holder
13 Keder
14 Keder flap
15 Keder bead
16 Protective covering
17 Dividers
18 Butt joint
19 Handle
20 Stacking support
21 Folding line
22 Connecting crosspiece
23 Corner
24 Cutout
25 Corner flap
26 Scored line

The invention claimed is:

1. A transport and storage container, comprising:
a base (1);
two side walls (2);
two end walls (3);
dividers (17) and/or a protective covering (16);
a stacking profile (9); and
a keder,
wherein the side walls (2) and the end walls (3) have rolled peripheries (10), which can be swung about a scored line (26) in each case onto the associated side wall (2) and end wall (3),
wherein the stacking profile (9) is open at a bottom and fitted on over the rolled peripheries (10) of the side walls (2) and of the end walls (3), the stacking profile having
an inner leg (6),
an outer leg (5), and
a hook periphery (8), which is formed on the outer leg (5) or inner leg (6) and, in a fitted-on state, can be latched over an end of the swung-over rolled peripheries (10) of the side walls (2) and of the end walls (3),
wherein a connecting crosspiece (20) between the outer leg (5) and the inner leg (6) forms a stacking support (20),
wherein the stacking profile (9) has an upper stacking periphery (7), which is formed on the outer leg (5),
wherein the connecting crosspiece (20) includes a keder holder (12), into which keders (13) having a keder bead (15) and a keder flap (14) are pushed,
wherein the protective covering (16) and/or the dividers (17) for accommodating transportation and storage items are fastened on at least one keder flap (14), and
wherein the stacking profile (9) comprises a continuous, multi-part profile in which individual parts of the stacking profile (9) can be swung outwards, about a folding line (11), at corners (23) of the transport and storage container to such an extent that a keder (13) can be pushed into the keder holder (12), and
wherein, in a region of the corners (23), the stacking profile (9) has V shaped cutouts (24), which allow the individual stacking-profile parts to be swung inward through approximately 90°.

2. The transport and storage container as claimed in claim 1,
wherein the stacking profile (9) is an injection molded plastic part.

3. The transport and storage container as claimed in claim 1,
wherein the stacking profile (9) is of five-part design and, in the fitted-on state, a first part of the stacking profile (9) is connected to a fifth part in abutment therewith.

4. The transport and storage container as claimed in claim 1,
wherein the base (1), the side walls (2), and the end walls (3) comprise plastic structured-core panels.

5. The transport and storage container as claimed in claim 1,
wherein the connecting crosspiece (22) has a cavity (4).

* * * * *